US008728580B2

(12) United States Patent
Kuniyasu et al.

(10) Patent No.: US 8,728,580 B2
(45) Date of Patent: May 20, 2014

(54) METHOD OF MANUFACTURING FILM WITH COATING

(75) Inventors: Satoshi Kuniyasu, Kanagawa (JP); Tamotsu Saikawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 226 days.

(21) Appl. No.: 13/432,023

(22) Filed: Mar. 28, 2012

(65) Prior Publication Data

US 2012/0251726 A1 Oct. 4, 2012

(30) Foreign Application Priority Data

Mar. 30, 2011 (JP) ..... P2011-075921

(51) Int. Cl.
*B05D 3/02* (2006.01)

(52) U.S. Cl.
USPC ..... 427/372.2

(58) Field of Classification Search
USPC ..... 427/372.2
See application file for complete search history.

(56) References Cited

U.S. PATENT DOCUMENTS

| | | | | |
|---|---|---|---|---|
| 5,256,357 | A * | 10/1993 | Hayward | 264/172.19 |
| 5,728,430 | A * | 3/1998 | Sartor et al. | 427/356 |
| 5,741,549 | A * | 4/1998 | Maier et al. | 427/294 |
| 5,834,052 | A * | 11/1998 | Fukumura et al. | 427/58 |
| 2007/0231478 | A1 * | 10/2007 | Watanabe et al. | 427/162 |

FOREIGN PATENT DOCUMENTS

| | | | |
|---|---|---|---|
| JP | 04-035765 | | 2/1992 |
| JP | 05-293425 | | 11/1993 |
| JP | H08-103712 | A | 4/1996 |
| JP | 9-511681 | A | 11/1997 |
| JP | 11-090296 | | 4/1999 |
| JP | 2002-059062 | A | 2/2002 |
| JP | 2002-163822 | A | 6/2002 |
| JP | 2003-260400 | A | 9/2003 |
| JP | 2010-204346 | A | 9/2010 |

OTHER PUBLICATIONS

Decision to Grant of JP2011-075921 dated Aug. 6, 2013.
Office Action of JP2011-075921 dated Mar. 14, 2013.

* cited by examiner

*Primary Examiner* — Nathan Empie
(74) *Attorney, Agent, or Firm* — Birch, Stewart, Kolasch & Birch, LLP

(57) ABSTRACT

The tip of a downstream lip is disposed so as to be further separated from a web as compared to the tip of an adjacent lip, and downstream and upstream spacers are placed so that the a liquid discharge port length interposed between two downstream spacers is shorter than that of a liquid discharge port interposed between two upstream spacers. The method includes coating coating-liquid to the surface of the web from a slot die, which is formed so that tips of the downstream spacers are placed at the same position as a tip of the adjacent lip or further protrude so as to be closer to the web than the tip of the adjacent lip; depressurizing the cover inside that is provided on the upstream side of the slot die during the coating; and drying the coating-liquid that is coated to the surface of the web.

4 Claims, 9 Drawing Sheets

FIG. 4A

| | POSITION OF TIP OF DOWNSTREAM LIP | APPLICATION WIDTH | POSITION OF TIP OF SPACER OF THE MOST DOWNSTREAM SLOT | STREAK DEFECT | EDGE BREAK DEFECT |
|---|---|---|---|---|---|
| COMPARATIVE EXAMPLE 1 | THE SAME AS POSITION OF TIP OF ADJACENT LIP | LOWER LAYER = UPPER LAYER | MOVE BACKWARD FROM TIP OF ADJACENT LIP | B | A |
| COMPARATIVE EXAMPLE 2 | THE SAME AS POSITION OF TIP OF ADJACENT LIP | LOWER LAYER = UPPER LAYER | COINCIDE WITH POSITION OF TIP OF ADJACENT LIP | B | A |
| COMPARATIVE EXAMPLE 3 | THE SAME AS POSITION OF TIP OF ADJACENT LIP | LOWER LAYER = UPPER LAYER | MOVE FORWARD FROM TIP OF ADJACENT LIP | B | A |
| COMPARATIVE EXAMPLE 4 | THE SAME AS POSITION OF TIP OF ADJACENT LIP | LOWER LAYER < UPPER LAYER | MOVE BACKWARD FROM TIP OF ADJACENT LIP | B | A |
| COMPARATIVE EXAMPLE 5 | THE SAME AS POSITION OF TIP OF ADJACENT LIP | LOWER LAYER < UPPER LAYER | COINCIDE WITH POSITION OF TIP OF ADJACENT LIP | B | A |

FIG. 4B

| | POSITION OF TIP OF DOWNSTREAM LIP | APPLICATION WIDTH | POSITION OF TIP OF SPACER OF THE MOST DOWNSTREAM SLOT | STREAK DEFECT | EDGE BREAK DEFECT |
|---|---|---|---|---|---|
| COMPARATIVE EXAMPLE 6 | THE SAME AS POSITION OF TIP OF ADJACENT LIP | LOWER LAYER < UPPER LAYER | MOVE FORWARD FROM TIP OF ADJACENT LIP | B | A |
| COMPARATIVE EXAMPLE 7 | THE SAME AS POSITION OF TIP OF ADJACENT LIP | LOWER LAYER > UPPER LAYER | MOVE BACKWARD FROM TIP OF ADJACENT LIP | B | A |
| COMPARATIVE EXAMPLE 8 | THE SAME AS POSITION OF TIP OF ADJACENT LIP | LOWER LAYER > UPPER LAYER | COINCIDE WITH POSITION OF TIP OF ADJACENT LIP | B | A |
| COMPARATIVE EXAMPLE 9 | THE SAME AS POSITION OF TIP OF ADJACENT LIP | LOWER LAYER > UPPER LAYER | MOVE FORWARD FROM TIP OF ADJACENT LIP | B | A |
| COMPARATIVE EXAMPLE 10 | MOVE FORWARD FROM TIP OF ADJACENT LIP | LOWER LAYER = UPPER LAYER | MOVE BACKWARD FROM TIP OF ADJACENT LIP | B | A |

FIG. 4C

| | POSITION OF TIP OF DOWNSTREAM LIP | APPLICATION WIDTH | POSITION OF TIP OF SPACER OF THE MOST DOWNSTREAM SLOT | STREAK DEFECT | EDGE BREAK DEFECT |
|---|---|---|---|---|---|
| COMPARATIVE EXAMPLE 11 | MOVE FORWARD FROM TIP OF ADJACENT LIP | LOWER LAYER = UPPER LAYER | COINCIDE WITH POSITION OF TIP OF ADJACENT LIP | B | A |
| COMPARATIVE EXAMPLE 12 | MOVE FORWARD FROM TIP OF ADJACENT LIP | LOWER LAYER = UPPER LAYER | MOVE FORWARD FROM TIP OF ADJACENT LIP | B | A |
| COMPARATIVE EXAMPLE 13 | MOVE FORWARD FROM TIP OF ADJACENT LIP | LOWER LAYER < UPPER LAYER | MOVE BACKWARD FROM TIP OF ADJACENT LIP | B | A |
| COMPARATIVE EXAMPLE 14 | MOVE FORWARD FROM TIP OF ADJACENT LIP | LOWER LAYER < UPPER LAYER | COINCIDE WITH POSITION OF TIP OF ADJACENT LIP | B | A |
| COMPARATIVE EXAMPLE 15 | MOVE FORWARD FROM TIP OF ADJACENT LIP | LOWER LAYER < UPPER LAYER | MOVE FORWARD FROM TIP OF ADJACENT LIP | B | A |

FIG. 4D

| | POSITION OF TIP OF DOWNSTREAM LIP | APPLICATION WIDTH | POSITION OF TIP OF SPACER OF THE MOST DOWNSTREAM SLOT | STREAK DEFECT | EDGE BREAK DEFECT |
|---|---|---|---|---|---|
| COMPARATIVE EXAMPLE 16 | MOVE FORWARD FROM TIP OF ADJACENT LIP | LOWER LAYER > UPPER LAYER | MOVE BACKWARD FROM TIP OF ADJACENT LIP | B | A |
| COMPARATIVE EXAMPLE 17 | MOVE FORWARD FROM TIP OF ADJACENT LIP | LOWER LAYER > UPPER LAYER | COINCIDE WITH POSITION OF TIP OF ADJACENT LIP | B | A |
| COMPARATIVE EXAMPLE 18 | MOVE FORWARD FROM TIP OF ADJACENT LIP | LOWER LAYER > UPPER LAYER | MOVE FORWARD FROM TIP OF ADJACENT LIP | B | A |
| COMPARATIVE EXAMPLE 19 | MOVE BACKWARD FROM TIP OF ADJACENT LIP | LOWER LAYER = UPPER LAYER | MOVE BACKWARD FROM TIP OF ADJACENT LIP | – | B |
| COMPARATIVE EXAMPLE 20 | MOVE BACKWARD FROM TIP OF ADJACENT LIP | LOWER LAYER = UPPER LAYER | COINCIDE WITH POSITION OF TIP OF ADJACENT LIP | – | B |

FIG. 4E

| | POSITION OF TIP OF DOWNSTREAM LIP | APPLICATION WIDTH | POSITION OF TIP OF SPACER OF THE MOST DOWNSTREAM SLOT | STREAK DEFECT | EDGE BREAK DEFECT |
|---|---|---|---|---|---|
| COMPARATIVE EXAMPLE 21 | MOVE BACKWARD FROM TIP OF ADJACENT LIP | LOWER LAYER = UPPER LAYER | MOVE FORWARD FROM TIP OF ADJACENT LIP | – | B |
| COMPARATIVE EXAMPLE 22 | MOVE BACKWARD FROM TIP OF ADJACENT LIP | LOWER LAYER < UPPER LAYER | MOVE BACKWARD FROM TIP OF ADJACENT LIP | – | B |
| COMPARATIVE EXAMPLE 23 | MOVE BACKWARD FROM TIP OF ADJACENT LIP | LOWER LAYER < UPPER LAYER | COINCIDE WITH POSITION OF TIP OF ADJACENT LIP | – | B |
| COMPARATIVE EXAMPLE 24 | MOVE BACKWARD FROM TIP OF ADJACENT LIP | LOWER LAYER < UPPER LAYER | MOVE FORWARD FROM TIP OF ADJACENT LIP | – | B |
| COMPARATIVE EXAMPLE 25 | MOVE BACKWARD FROM TIP OF ADJACENT LIP | LOWER LAYER > UPPER LAYER | MOVE BACKWARD FROM TIP OF ADJACENT LIP | – | B |

FIG. 4F

| | POSITION OF TIP OF DOWNSTREAM LIP | APPLICATION WIDTH | POSITION OF TIP OF SPACER OF THE MOST DOWNSTREAM SLOT | STREAK DEFECT | EDGE BREAK DEFECT |
|---|---|---|---|---|---|
| EXAMPLE 1 | MOVE BACKWARD FROM TIP OF ADJACENT LIP | LOWER LAYER > UPPER LAYER | COINCIDE WITH POSITION OF TIP OF ADJACENT LIP | A | A |
| EXAMPLE 2 | MOVE BACKWARD FROM TIP OF ADJACENT LIP | LOWER LAYER > UPPER LAYER | MOVE FORWARD FROM TIP OF ADJACENT LIP | A | A |

METHOD OF MANUFACTURING FILM WITH COATING

BACKGROUND OF THE INVENTION

1. Field of the Invention

The present invention relates to a method of manufacturing a film with a coating layer by coating coating-liquid to the surface of a web (film), which is continuously transported, with an extrusion type die, and more particularly, to a method of manufacturing a film with a coating layer that simultaneously coats a plurality of coating layer to a web.

2. Description of the Related Art

Until now, a bar coater type coating device, a reverse roll coater type coating device, a gravure roll coater type coating device, and a slot die coater type coating device such as an extrusion coater type coating device are known as coating devices that coat or form an coating film (coating layer) having a desired thickness to the surface of a flexible support (hereinafter, also referred to as a web).

Among them, a slot die coater type coating device can coat a thin film (thin layer) at a high speed in comparison with other type coating devices. For this reason, the slot die coater type coating device is widely used. In recent years, the demand for a liquid crystal monitor has increased with the spread of personal computers and the reduction of the thickness of home televisions. Accordingly, the demand for optical films, such as a polarizing film and an optical compensation film, requiring the formation of a thin film has also increased. For this reason, a slot die coater type coating device, which can form a thin film and can form a multilayer film, has been under the spotlight.

There is a bead depressurization overbite type slot die as a slot die that has been used often in the past in this slot die coater type simultaneous multilayer coating device (see JP1997-511681A (JP-H09-511681A) and JP2003-260400A).

An overbite slot die refers to, for example, a slot die where a tip portion (referred to as a lip) of a die block (referred to as the most downstream block), which is provided on the most downstream side in the advancing direction of the web, of die blocks (simply referred to as blocks) constituting a slot die protrudes downward as compared to a lip of a die block (referred to as an adjacent block) adjacent to the most downstream block.

In other words, for example, a slot die where a distance between the lip of the most downstream block and the web is shorter than a distance between the adjacent block and the web is referred to as an overbite slot die.

SUMMARY OF THE INVENTION

Meanwhile, recently, there has been a demand for the reduction of the thickness of a film, which is coated on a film, from the market. It is advantageous to use coating-liquid having a low viscosity (40 mPa·s or less) in order to coat a thin film. In the case of single-layer coating, the shape of a good coating surface is obtained since it is possible to suppress the terraced unevenness (a defect where a thick portion, a thin portion, a thick portion, a thin portion . . . appear alternately in the direction orthogonal to the advancing direction of the web) of coating-liquid having a low viscosity at an overbite slot die.

However, a bead of coating-liquid of the uppermost layer formed between a slot die and a web cannot be uniformly formed in a width direction when multilayer coating is to be performed by an overbite slot die as in JP1997-511681A (JP-H09-511681A) or JP2003-260400A. For this reason, there has been a problem in that streaks (linear portions parallel to the advancing direction of the web and having different thicknesses) are formed.

The inventors found that it is possible to solve this problem by using not an overbite slot die, but an underbite slot die as a result of earnest examination.

An underbite slot die means, for example, a slot die where the tip of a lip of the most downstream block is withdrawn so as to be further separated from the web as compared to the tip of a lip of the adjacent block. In other words, a slot die where a distance between the tip of the lip of the most downstream block and the web is longer than a distance between the tip of the lip of the adjacent block and the web, is referred to as an underbite slot die.

Meanwhile, when a film is formed by an underbite slot die through the multilayer coating of coating-liquid having a low viscosity, a new problem is occurred.

The problem is a surface-shaped defect called edge break where the bead of coating-liquid formed between the slot die and the web is broken from an end portion thereof in the width direction of the web immediately after the formation of an coating film. If this defect where the end portion of the bead is broken occurs, the bead will be broken on the entire surface of the web. The broken bead does not recovered by itself.

As a result of the earnest examination of this serious problem, it was found that edge break becomes obvious by coating coating-liquid having a viscosity of 0.5 mPa·s to 40 mPa·s in the form of a thin layer of about 25 cc/$m^2$ or less as an uppermost layer, performing bead depressurization (a method of preventing the break of the bead at the upstream lip by depressurizing the upstream side of the slot die), and separating the tip of the most downstream lip from the web as compared to the tip of the adjacent lip, that is, by setting underbite.

The generation mechanism of edge break is assumed to be as follows: that is, when bead depressurization is performed, a bead is pulled toward not only the upstream side in the transport direction of the web but also the end portion in the width direction of the web. Accordingly, the amount of liquid of the end portion of the bead is reduced. When the amount of liquid becomes equal to or less than the limit thereof, a bead of coating-liquid cannot be formed between the slot die and the web. This is assumed to be an edge break phenomenon.

A distance between the tip of the lip of the most downstream block and the web is increased in the case of underbite as compared to the case of overbite. Accordingly, a pressure loss is reduced, so that the degree of pulling toward the end portion in the width direction of the web is also increased (a distance where the end portion of the bead of the liquid of an upper layer is subjected to depressurization is increased, so that the degree of pulling of the bead toward the end portion in the width direction of the web is also increased). This is the most important factor that causes edge break to be easily generated.

As coating speed and viscosity of the coating-liquid of the uppermost layer become higher, edge break tends to be easily generated. The reason for this is estimated that the amount of coating-liquid at portions coming into contact with the spacers is reduced and is not stably maintained since the coating-liquid of an end portion easily flows inward (since a contracted flow is easily generated).

Meanwhile, the excessively low viscosity of the coating-liquid is also a factor that causes edge break to be easily generated. Since the friction between the tip face of the lip and liquid is reduced as the viscosity of liquid becomes lower when liquid receives a force, liquid easily moves. It is considered that edge break is easily generated since the amount of liquid at the end portions is reduced as liquid more easily moves outward.

Meanwhile, a streak defect different from a defect where the bead is broken is seen at an coating film that is obtained within a short time when the defect of bead breaking occurs after the formation of the coating film. As a result of earnest examination, it was found that a streak defect tends to occurs when the length of a land of a lip adjacent to the most downstream lip is short, specifically, is smaller than 50 μm. The generating mechanism of this streak defect is assumed as the slight variation of the position of a liquid-liquid interface that is caused by small disturbance. It is preferable that the length of the land of the lip adjacent to the most downstream lip is 50 μm or more where robustness against the sight variation of the position of a liquid-liquid interface is high.

The present invention has been made in view of the above-mentioned problems and an object of the present invention is to provide a method of manufacturing a film with a coating layer that does not cause streak and edge break even though coating-liquid having a low viscosity is used.

An object of the present invention can be achieved by the following invention.

That is, according to an aspect of the present invention, there is provided a method of manufacturing a film with a coating layer that forms a coating on a film by discharging coating-liquid having a viscosity of 40 mPa·s or less from tips of a plurality of slots formed at a slot die constituted by a plurality of blocks and simultaneously coating the coating-liquid to the surface of a web, which is supported by a back-up roller and continuously runs, in the form of two or more layers. The method of the present invention includes a coating step, a depressurizing and a drying step. The tip of a downstream lip, which is positioned on the most downstream side in an advancing direction of the web, is disposed so as to be further separated from the web as compared to the tip of an adjacent lip adjacent to the downstream lip. Downstream spacers and upstream spacers are placed so that a liquid discharge width interposed between two downstream spacers fitted into a downstream slot, which is positioned on the most downstream side, of the slots is shorter than a liquid discharge width interposed between two upstream spacers fitted into an adjacent slot, which is positioned directly on the upstream side of the downstream slot. The coating step includes coating coating-liquid to the surface of the web from the slot die which is formed so that tips of the downstream spacers are placed at the same position as the position of a tip of the adjacent lip in terms of a distance from the web or further protrude so as to be closer to the web than the tip of the adjacent lip. The depressurizing step depressurizes the inside of a cover that is provided on the upstream side of the slot die during the coating of the coating-liquid. The drying step dries the coating-liquid that is coated to the surface of the web.

Accordingly, it is possible to form a film by multilayer coating without causing a streak defect and an edge break defect in the case of the coating-liquid having a low viscosity. Therefore, it is possible to manufacture a film with a coating layer.

It is possible to manufacture a film with a coating layer without causing a streak defect and an edge break defect.

BRIEF DESCRIPTION OF THE DRAWINGS

FIGS. 4A to 4F are a table showing the evaluation results of film formation.

DESCRIPTION OF THE PREFERRED EMBODIMENTS

Figure 1:
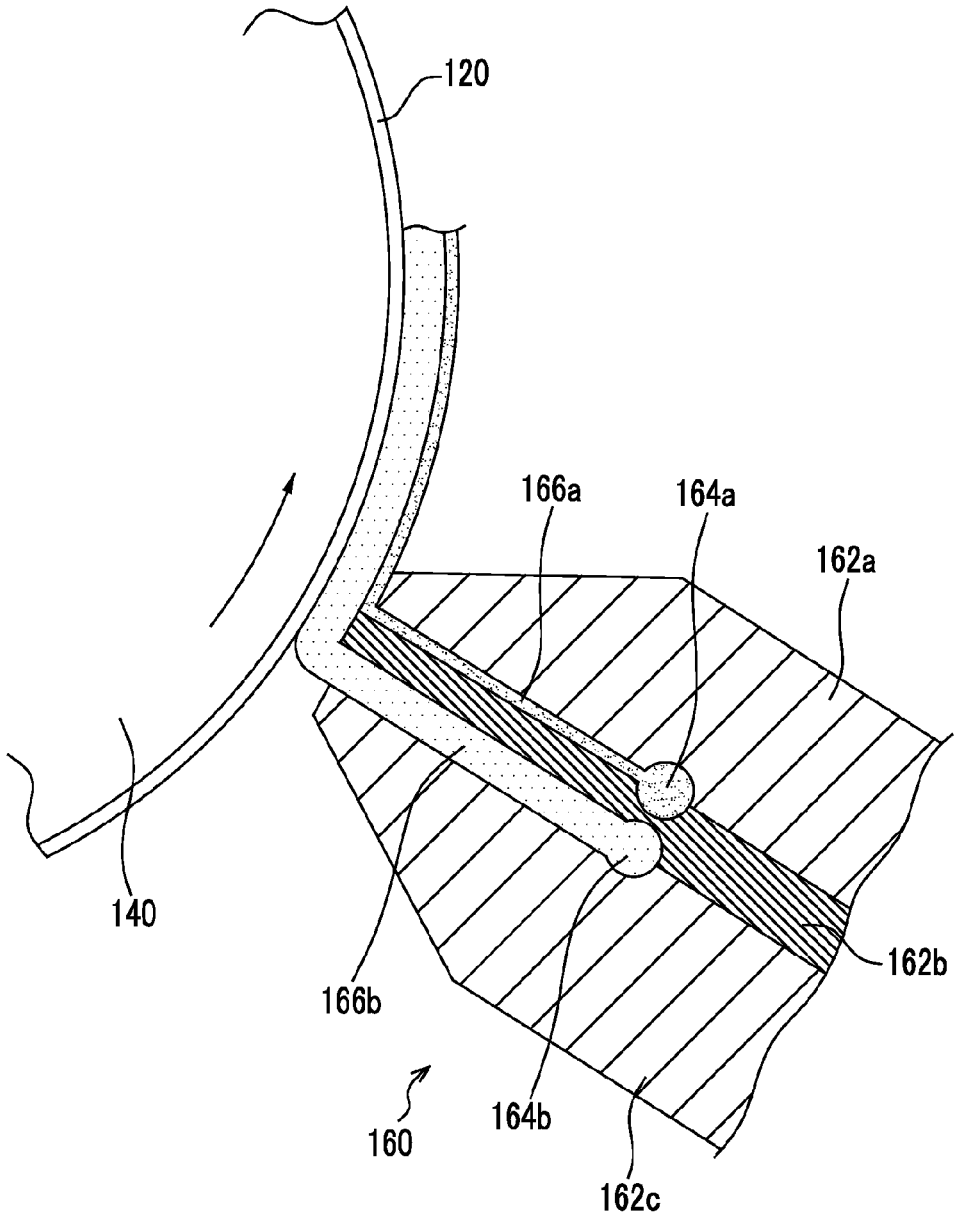
FIG. 1 is a cross-sectional view of an example of a coating device of the present invention.

An embodiment of the present invention will be described in detail below with reference to the accompanying drawings. Here, portions, which are denoted in the drawings by the same reference numerals, are the same elements having the same functions. Further, when a range of a numerical value is represented by "* to *", numerical values of the upper and lower limits of "* to *" are also included in the range of the numerical values in this specification.

<Structure of Coating Device>

An coating device used in the present invention uses an extrusion type die, and forms a laminated film by coating coating-liquid to the surface of a web, which is supported by a back-up roller and continuously runs, so as to simultaneously form two or more films on the surface of the web with the coating-liquid.

An embodiment of the coating device used in the present invention will be described with reference to the drawings. FIG. 1 is a cross-sectional view of an example of the coating device used in the present invention. The coating device of the present invention mainly includes a back-up roller 140 that supports and rotates a web 120, and a slot die 160 that coats coating-liquid to the web 120.

The slot die 160 includes a plurality of blocks 162*a*, 162*b*, and 162*c*. Pockets 164*a* and 164*b* and slots 166*a* and 166*b*, which extend to the tip portion of the slot die 160 from the pockets 164*a* and 164*b*, are formed in the slot die 160 by the combination of the plurality of blocks. Further, spacers (not shown) are fitted to both end portions of the slots 166*a* and 166*b* (both end portions on the near side and far side in FIG. 1).

The pockets 164*a* and 164*b* have a curved cross-sectional shape, and the shape thereof may be a approximately circular shape as shown in FIG. 1 and may be a semi-circular shape. The pockets 164*a* and 164*b* are liquid pool spaces for coating-liquid of which the cross-sectional shapes extend in the width direction of the slot die 160 (in the direction perpendicular to the transport direction of the web 120).

Here, three blocks 162*a*, 162*b*, and 162*c*, two pockets 164*a* and 164*b*, and two slots 166*a* and 166*b* are shown in FIG. 1. However, the number of blocks is not limited to three, and the number of pockets and the number of slots are also not limited to two. It is possible to form a required quantity of pockets and slots with a required quantity of blocks in accordance with the kinds and the number of coating films to be required.

A lip, which is the tip portion of the die, is placed so as to be spaced from the web 120 by a predetermined distance. When the tip portion of the block 162*a*, which is a block positioned on the most downstream side in the transport direction of the web 120 (hereinafter, all of the upstream, the downstream, the upstream side, the downstream side, and the like mean the upstream (side) and the downstream (side) in the transport direction of the web 120), is referred to as a downstream lip, the tip portion of the block 162*b*, which is a block positioned in the middle (which is a block adjacent to the downstream lip and is a block positioned directly on the upstream side of the block positioned on the most downstream side), is referred to as an adjacent lip, and the tip portion of the block 162*c*, which is a block positioned on the most upstream side, is referred to as an upstream lip, the die is formed so that a distance between the downstream lip and the web is longer than a distance between the adjacent lip and the web. That is, the slot die 160 of the present invention is underbite.

Here, a phenomenon where beads, which are formed on the surface of the web by the coating-liquid discharged from the tip of the slot die 160, are broken away during the formation of a film may occur. In order to suppress this phenomenon, it is necessary to depressurize the beads from the upstream side in the transport direction of the web.

For the purpose of the depressurization of the beads from the upstream side in the transport direction of the web, a cover is provided on the upstream side of the slot die 160 and air in the cover may be sucked by a pump.

Figure 2:
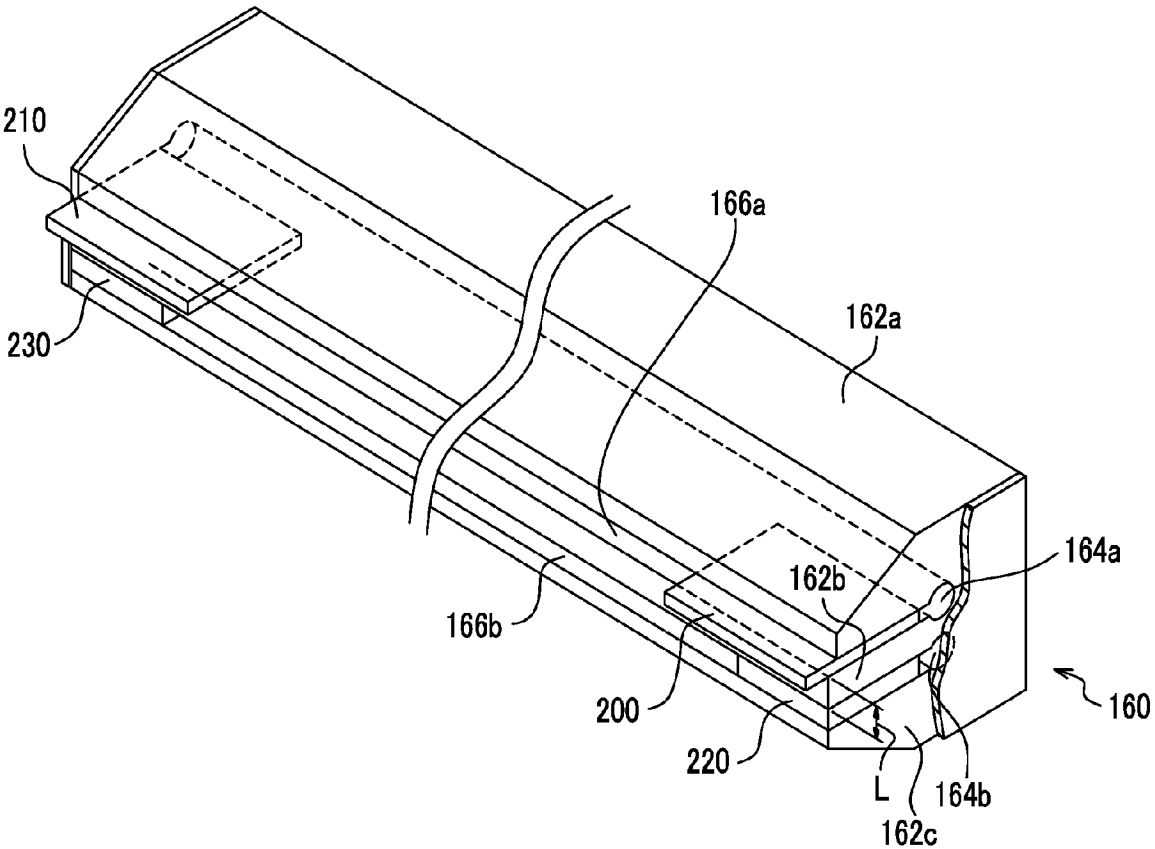
FIG. 2 is a schematic perspective view of the coating device of the present invention.

Next, characteristic portions of the coating device used in the present invention will be described in detail with reference to FIG. 2. FIG. 2 is a schematic perspective view of the coating device used in the present invention. As shown in FIG. 2, spacers 200 and 210 are fitted to both ends of the slot 166*a* in the longitudinal direction of the slot 166*a*. Further, spacers 220 and 230 are fitted to both ends of the slot 166*b* in the longitudinal direction of the slot 166*b*.

These spacers prevent coating-liquid from flowing out of both ends of the slots in the longitudinal direction. Here, as the characteristics of the present invention, the tips of the spacers (downstream spacers) 200 and 210 provided on the downstream side protrude so as to be closer to the web than the adjacent lip. The adjacent lip and the tips of the spacers 200 and 210 may be spaced from the web by the same distance without protruding. However, the tips of the spacers 200 and 210 further protrude as compared to the adjacent lip by a distance of, preferably, 5 μm or more and, more preferably, 11 μm or more. The reason for this is to stably maintain the end portion of an coating film even though there is a disturbance. Further, it is preferable that the tips of the downstream spacers do not come into contact with a lower film, that is, the tips of the downstream spacers be separated from the surface of the lower film. If the tips of the downstream spacers come into contact with the lower film, the lower film is scraped away. This scraping trigger a high possibility of occurring coating defects.

Furthermore, as the characteristics of the coating device used in the present invention, a downstream coating width, which is the length of the slot 166*a* interposed between the two spacers 200 and 210 provided on the downstream side, is shorter than an upstream coating width that is the length of the slot 166*b* interposed between the two spacers 220 and 230 provided on the upstream side. If the downstream coating width is not smaller than the upstream coating width even though the tips of the downstream spacers protrude, it is difficult to suppress edge break.

In a method of manufacturing a film with a coating layer according to the present invention, it is possible to form a good film without causing a streak defect and an edge break defect due to these characteristics even though a film is formed using coating-liquid having a low viscosity (40 mPa·s or less). Here, it is possible to form a good film without causing not only a streak defect, but also an edge break defect, even though the viscosity of the coating-liquid is in the range of viscosity but in the range of 0.5 mPa·s to 40 mPa·s. It is considered that it is possible to form a good film without defects even though the viscosity of the coating-liquid is lower than 0.5 mPa·s. However, since there is no coating-liquid having a viscosity lower than 0.5 mPa·s, evaluation is difficult.

<Method of Manufacturing Film with Coating>

Next, a method of manufacturing a film with a coating layer according to the present invention will be described. In the method of manufacturing a film with a coating layer according to the present invention, a film with a coating layer is manufactured using the above-mentioned coating device. That is, a method of manufacturing a film with a coating layer according to the present invention mainly includes an coating step of discharging coating-liquid having a viscosity of 40 mPa·s or less from tips of a plurality of slots formed at a slot die including a plurality of blocks and simultaneously coats the coating-liquid to the surface of a web, which is supported by a back-up roller and continuously runs, in the form of two or more layers; a depressurization step of depressurizing an upstream side of the slot die during the coating step; and a drying step that dries the coating-liquid coated to the surface of the web.

The coating step will be further described. The coating step is a step of coating coating-liquid to the surface of the web from the slots that are underbite. At the slots, the tips of the downstream spacers are placed at the same position as the position of the tip of the adjacent lip or further protrude as compared to the tip of the adjacent lip, and a liquid discharge width, which is the length of a liquid discharge port interposed between the downstream spacers (the length of the liquid discharge port interposed between the spacers in the axial direction of the back-up roller is referred to as the liquid discharge width), is shorter than a liquid discharge width interposed between the spacers positioned next on the upstream side of the downstream spacers.

Here, underbite means that the tip of the downstream lip positioned on the most downstream side in the advancing direction of the web is positioned so as to be further separated from the web as compared to the tip of the adjacent lip adjacent to the downstream lip positioned on the most downstream side.

Further, the fact that the tips of the downstream spacers further protrude as compared to the tip of the adjacent lip means that the tips of the downstream spacers are close to the surface of the web as compared to the tip of the adjacent lip.

Furthermore, the fact that the liquid discharge width interposed between the downstream spacers is shorter than the liquid discharge width interposed between the spacers positioned next on the upstream side of the downstream spacers means that the downstream spacers and the upstream spacers are placed so that the liquid discharge width interposed between the two downstream spacers fitted into the downstream slot, which is positioned on the most downstream, of the slots is smaller than the liquid discharge width interposed between the two upstream spacers fitted into the adjacent slot positioned next on the upstream side of the downstream slot.

Next, the depressurization step will be described. In the depressurization step, the upstream side of the slot die is made to be in a depressurized state. Specifically, the upstream side of the slot die is covered with the cover and air in the cover is sucked by the pump, so that the upstream side of the slot die can be depressurized. The depressurization step and the coating step are performed simultaneously.

Next, the drying step will be described. In the drying step, the coating-liquid can be dried using various drying methods having been performed in the past. An coating film coated to a film can be dried by, for example, slit air drying, mesh air drying, infrared drying, condensation drying, or the like.

Figure 3:
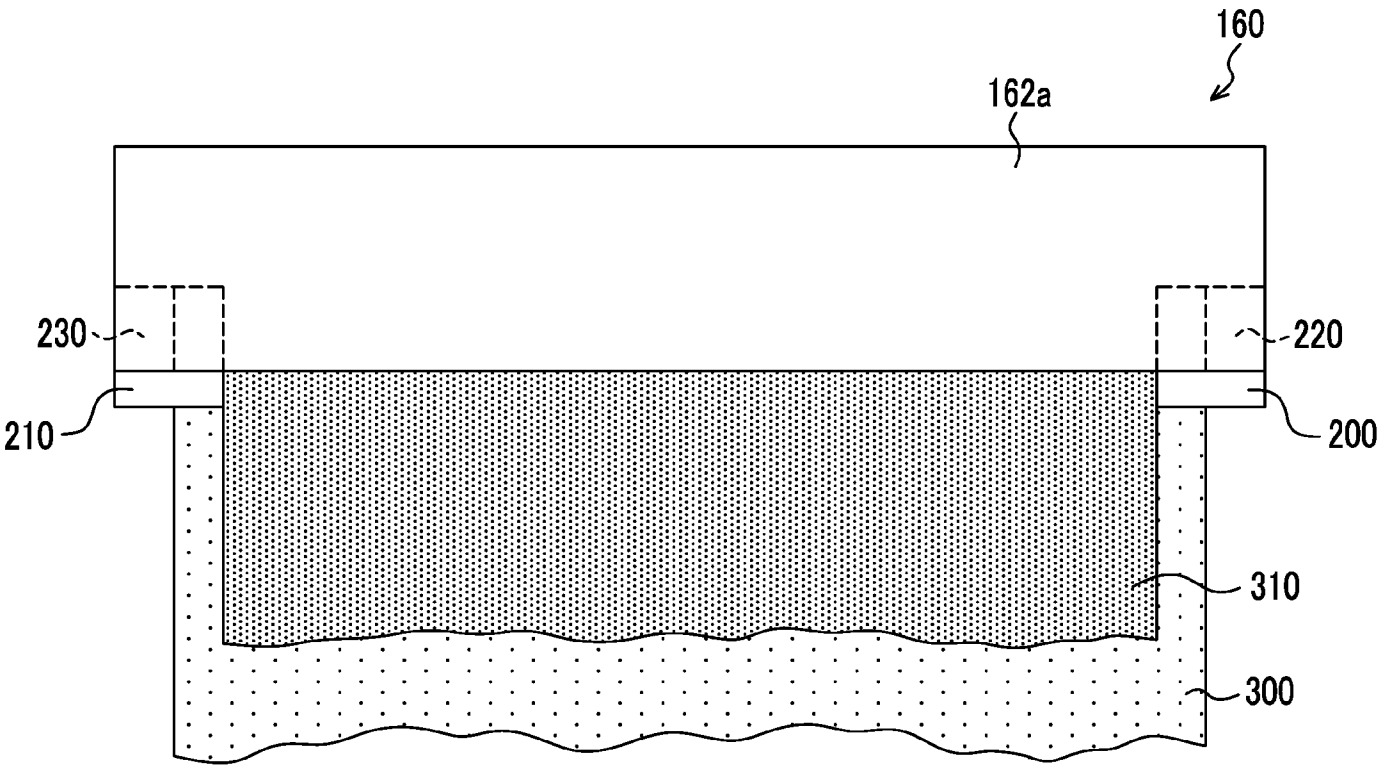
FIG. 3 is a view illustrating a film-formation state of the coating device.

Next, a film-formation state will be described with reference to FIG. 3. FIG. 3 is a view illustrating a film-formation state of the coating device. As shown in FIG. 3, the length (downstream coating width) of the liquid discharge port of the slot 166*a*, which is interposed between the spacers 200 and 210 on the downstream side, is shorter than the length (upstream coating width) of the liquid discharge port of the slot 166*b* that is interposed between the spacers 220 and 230 on the upstream side.

Accordingly, the length of an coating film 310, which is formed using the coating-liquid flowing out of the slot 166*a*, in the width direction (the longitudinal direction in FIG. 3) is shorter than the length of an coating film 300, which is formed using the coating-liquid flowing out of the slot 166*b*, in the width direction. Accordingly, the coating film 310 is placed on the coating film 300 without protruding from the coating film 300.

<Evaluation>

While the position of the tip of the downstream lip, the coating width, and the positions of the tips of the spacers 200 and 210 fitted into the slot 166*a* that is the most downstream slot were used as parameters, a film was formed by the simultaneous multilayer coating of coating-liquid having a viscosity of 40 mPa·s and the occurrence of a streak defect and an edge break defect was evaluated.

Evaluation results are shown in FIGS. 4A to 4F. FIGS. 4A to 4F are a table showing the evaluation results of film formation. As for the streak defect and the edge break defect shown in FIGS. 4A to 4F, "A" means good (that a defect does not occur) and "B" means that a defect occurs. "–" means that the occurrence of a defect cannot be evaluated since a film is not formed well.

As for the position of the tip of the downstream lip, "THE SAME AS POSITION OF TIP OF ADJACENT LIP" means that the tip of the downstream lip and the tip of the adjacent lip are disposed at the same position in terms of a distance from the web, "MOVE FORWARD FROM TIP OF ADJACENT LIP" means that the tip of the downstream lip protrudes toward the web as compared to the tip of the adjacent lip, and "MOVE BACKWARD FROM TIP OF ADJACENT LIP" means that the tip of the downstream lip is positioned after moving backward so as to be further separated from the web in a direction toward the web as compared to the tip of the adjacent lip.

Further, as for the coating width, "LOWER LAYER=UPPER LAYER" means that the coating width of the lower layer is equal to that of the upper layer, that is, the lengths of the discharge ports of the slots of the upper and lower layers interposed between the spacers are equal to each other, "LOWER LAYER>UPPER LAYER" means that the coating width of the lower layer is larger than that of the upper layer, and "LOWER LAYER<UPPER LAYER" means that the coating width of the lower layer is smaller than that of the upper layer.

Furthermore, as for the position of the tip of the spacer of the most downstream slot, "MOVE BACKWARD FROM TIP OF ADJACENT LIP" means that the positions of the tips of the spacers fitted into the most downstream slot are a position moved so as to be further separated from the web as compared to the position of the tip of the adjacent lip, "COINCIDE WITH POSITION OF TIP OF ADJACENT LIP" means that the positions of the tips of the spacers fitted into the most downstream slot are the same as the position of the tip of the adjacent lip in terms of a distance from the web, and "MOVE FORWARD FROM TIP OF ADJACENT LIP" means that the positions of the tips of the spacers fitted into the most downstream slot are a position moved closer to the web than the position of the tip of the adjacent lip.

Comparative Examples 1 to 9 correspond to a condition where the positions of the downstream lip is the same as that of the adjacent lip, and Comparative Examples 10 to 18 correspond to a condition where the downstream lip moves forward from the adjacent lip (overbite). All of these correspond to the structure of an coating device in the related art.

Even though the coating width and the positions of the tips of the spacers of the most downstream slot, which are the other conditions, were changed in any way when the simultaneous multilayer coating of coating-liquid, which has a low viscosity and is used in the coating device in the related art, was performed, an edge break defect, which is one of the problems of the present invention, did not occur as shown by Comparative Examples 1 to 18.

However, when coating-liquid having a low viscosity was used in the coating device in the related art, a streak defect occurred as for all the conditions as shown by Comparative Examples 1 to 18. For this reason, it was not possible to form a film well.

Comparative Examples 19 to 25 and Examples 1 and 2 show evaluation results in a device where the position of the tip of the downstream lip moves backward from the position of the tip of the adjacent lip, that is, an underbite device. Here, a device where the position of the tip of the downstream lip moves backward from the position of the tip of the adjacent lip by a distance of 100 μm is used as this device.

Only when the coating width of the lower layer is larger than that of the upper layer and when the positions of the tips of the spacers fitted into the most downstream slot are same as the position of the tip of the adjacent lip or are a position moved closer to the web than the position of the tip of the adjacent lip in the underbite device, it was turned out that not only a streak defect but also an edge break defect did not occur as shown by Comparative Examples 19 to 25 and Examples 1 and 2.

Next, Examples 1 and 2 will be described in more detail.

Both a streak defect and an edge break defect did not occur in Example 1, but an edge break defect occurred when an ear position (the positions of both end portions of the bead of the coating-liquid in the longitudinal direction) of the upper layer was moved by disturbance. Accordingly, in order to make the positions of the tips of the spacers of the most downstream slot, which are the condition of Example 1, coincide with the position of the tip of the adjacent lip, it is necessary to reduce disturbance, such as the variation of coating clearance or the variation of the amount of sent liquid, as much as possible.

When the positions of the tips of the spacers of the most downstream slot were a position moved forward from the position of the tip of the adjacent lip by a distance of 10 μm, both a streak defect and an edge break defect did not occur and the evaluation result was good in Example 2. Further, even when the ear position of the upper layer was moved by disturbance, edge break did not occur. Furthermore, when the positions of the tips of the spacers of the most downstream slot are a position moved forward from the position of the tip of the adjacent lip by a distance of 15 μm, both a streak defect and an edge break defect did not occur, the ear position of the upper layer was not changed, and the appearance and the like of the coating film were also very good. However, when the tips of the spacers of the most downstream slot came into contact with the adjacent lower film, a defect where the thickness of the end portion of the coating film becomes non-uniform might occur in all of the above-mentioned cases. Accordingly, it is preferable that the tips of the spacers of the most downstream slot come into contact with the film.

Here, coating-liquid having a viscosity of 40 mPa·s has been used in this evaluation, but the same results were obtained even when coating-liquid having a viscosity of 0.5 mPa·s to 40 mPa·s, which is equal to or lower than the viscosity of the above-mentioned coating-liquid, was used. Further, the coating device having two slots has been described as an example in this embodiment. However, the present invention is not limited to a case where the coating device includes two slots, and the same operation and effect are obtained even when the coating device includes three or more slots.

As described above, the coating device of the present invention can form a film well without causing a streak defect and an edge break defect in the case of the coating-liquid having a low viscosity of 0.5 mPa·s to 40 mPa·s.

What is claimed is:

1. A method of manufacturing a film with a coating layer that forms a coating layer on a web by discharging coating-liquid having a viscosity of 0.5 mPa·s to 40 mPa·s from tips of a plurality of slots formed at a slot die constituted by a plurality of blocks and simultaneously coating the coating-liquid to the surface of a web, which is supported by a back-up roller and continuously runs, in the form of two or more layers, the method of manufacturing a film with a coating layer including the steps of:

a coating step wherein the tip of a downstream lip, which is positioned on the most downstream side in an advancing direction of the web, is disposed so as to be further separated from the web as compared to the tip of an adjacent lip adjacent to the downstream lip, and downstream spacers and upstream spacers are placed so that a liquid discharge width interposed between two downstream spacers fitted into a downstream slot, which is positioned on the most downstream side of the slots is shorter than a liquid discharge width interposed between two upstream spacers fitted into an adjacent slot, which is positioned directly on the upstream side of the downstream slot, and coating coating-liquid to the surface of the web from the slot die, which is formed so that tips of the downstream spacers are placed at the same position as the position of a tip of the adjacent lip in terms of a distance from the web or further protrude so as to be closer to the web than the tip of the adjacent lip;

a depressurizing step depressurizing the inside of a cover that is provided on the upstream side of the slot die during the coating of the coating-liquid; and a drying step drying the coating-liquid that is coated to the surface of the web.

2. The method according to claim 1, wherein the coating-liquid is coated in the coating step while the tips of the downstream spacers are closer to the web than the tip of the adjacent lip by a distance of 5 μm or more.

3. The method according to claim 2, wherein the coating-liquid is coated in the coating step while the tips of the downstream spacers are separated from a surface of a lower coating layer.

4. The method according to claim 1, wherein the coating-liquid is coated in the coating step while the tips of the downstream spacers are spaced from a surface of a lower coating layer.

* * * * *